US007193599B2

(12) United States Patent
Kim et al.

(10) Patent No.: US 7,193,599 B2
(45) Date of Patent: Mar. 20, 2007

(54) LIQUID CRYSTAL DISPLAY

(75) Inventors: Young-Ki Kim, Kumi (KR); Seung-Woo Lee, Seoul (KR)

(73) Assignee: Samsung Electronics Co, Ltd., Suwon (KR)

( * ) Notice: Subject to any disclaimer, the term of this patent is extended or adjusted under 35 U.S.C. 154(b) by 543 days.

(21) Appl. No.: 10/673,208

(22) Filed: Sep. 30, 2003

(65) Prior Publication Data

US 2004/0095308 A1 May 20, 2004

(30) Foreign Application Priority Data

Oct. 2, 2002 (KR) ..... 10-2002-0060115

(51) Int. Cl.
*G09G 3/36* (2006.01)

(52) U.S. Cl. ..... 345/98; 345/100

(58) Field of Classification Search ..... 345/76–100
See application file for complete search history.

(56) References Cited

U.S. PATENT DOCUMENTS 4,750,813 A * 6/1988 Ohwada et al. ..... 345/87
5,430,460 A * 7/1995 Takabatake et al. ..... 345/96
6,842,161 B2 * 1/2005 Song et al. ..... 345/87
2003/0038766 A1 * 2/2003 Lee et al. ..... 345/87

FOREIGN PATENT DOCUMENTS

JP 04322216 A * 11/1992

* cited by examiner

*Primary Examiner*—Alexander Eisen
(74) *Attorney, Agent, or Firm*—MacPherson Kwok Chen & Heid LLP

(57) ABSTRACT

A liquid crystal display includes a liquid crystal panel including a plurality of pixel rows, a plurality of data lines for transmitting data voltages to the pixel rows, a plurality of gate lines for transmitting gate signals to the pixel rows. The pixel rows includes a plurality of pairs of first and second pixel rows adjacent to each other. The first and the second pixel rows sequentially arranged in a data voltage moving direction and supplied with the data voltages having different polarities. The gate signals include first and second gate signals respectively applied to the first and the second pixel rows, and pulse widths of the second gate signals are increased by first modulation amounts.

12 Claims, 6 Drawing Sheets

LIQUID CRYSTAL DISPLAY

BACKGROUND OF THE INVENTION (a) Field of the Invention

The present invention relates to a liquid crystal display, and in particular, to a gate pulse width modulation method of a liquid crystal display.

(b) Description of Related Art

A liquid crystal display (LCD) includes an upper panel including a common electrode and a plurality of color filters and coated with an alignment layer, a lower layer including a plurality of pixel electrodes and thin film transistors (TFTs) and coated with an alignment layer, and a liquid crystal (LC) layer filled in a gap between the upper panel and the lower panel. The LCD generates electric fields in the LC layer by applying respective voltages to the pixel electrodes and the common electrode. The orientations of the LC molecules in the LC layer, which determine polarization of light passing through the LC layer, vary depending on the field strength. A polarizer or a pair of a polarizer and an analyzer convert the light polarization into the transmittance of the light. Accordingly, the LCD displays desired images by controlling the voltages applied to the pixel electrodes and the common electrode.

In circuital view, the LCD includes a plurality of pixels arranged in a matrix and a plurality of signal lines connected to the pixels such as gate lines and data lines. Each pixel includes a LC capacitor including a pixel electrode, a common electrode, and a liquid crystal disposed between the pixel electrode and the common electrode, a switching element such as a TFT connected between the signal lines and the LC capacitor, and a storage capacitor connected to the switching element in parallel to the LC capacitor. The switching element selectively transmits data voltages from a data line connected thereto in response to the gate signal from a gate line connected thereto. The gate signal includes a gate-on voltage for turning on the switching element and a gate-off voltage for turning off the switching element. The LC capacitor is charged for the duration of the gate-on voltage.

In the meantime, since long-term application of a unidirectional electric field deteriorates the characteristics of the LC layer, the voltages applied to the pixel electrodes (referred to as "data voltages" hereinafter) are periodically reversed with respect to the voltage applied to the common electrode (referred to as "common voltage" hereinafter) such that the field direction applied to the LC molecules is periodically reversed. This technique is called "inversion."

There are several types of the inversion such as one-dot inversion and double-dot inversion. The one-dot inversion reverses the polarity every row and every column, while the double-dot inversion reverses the polarity every two rows and every two columns.

When an LCD is subject to the double-dot inversion, the charging time of a pixel having a polarity opposite that of a previous pixel located along a column direction is longer than the charging time of a pixel having the same polarity as a previous pixel located along a column direction. If the duration of the gate-on voltage for the former pixel is short, the data voltage is not fully charged in the pixel. Therefore, there is an unbalance in charged voltages between the former pixel and the latter pixel. Such an unbalance causes defects on an LCD screen such as transverse stripes. The problem is particularly severe for a large, high resolution LCD since the duration of the gate-on voltage depends on the size and the resolution of the LCD and it is very short for the large, high resolution LCD.

SUMMARY OF THE INVENTION

A motivation of the present invention is to reduce the generation of transverse stripes.

A liquid crystal display is provided, which includes: a liquid crystal panel including a plurality of pixel rows, a plurality of data lines for transmitting data voltages to the pixel rows, a plurality of gate lines for transmitting gate signals to the pixel rows; a signal controller for generating a control signal for controlling timing of the gate signals; a data driver for providing the data voltages for the pixel rows through the data lines under control of the signal controller; and a gate driver for providing the gate signals to the pixel rows in sequence through the gate lines based on the control signal of the signal controller, wherein the pixel rows includes a plurality of pairs of first and second pixel rows adjacent to each other, sequentially arranged in a data voltage moving direction, and supplied with the data voltages having different polarities, the gate signals include first and second gate signals respectively applied to the first and the second pixel rows, and pulse widths of the second gate signals are increased by first modulation times, the first modulation times falling between a minimum value capable of compensating the charging time of pixels in the second pixel rows and a maximum value capable of preventing the inversion of transverse stripes.

Pulse widths of the first gate signals are preferably decreased by second modulation times. Preferably, the polarity of the data voltages are reversed every two pixel rows and the first modulation times are substantially equal to the respective second modulation times.

The first modulation time for one of the second pixel rows farther from inputs of the data voltages has a larger value than the first modulation times for the second pixel rows preceding the one of the second pixel rows.

The first modulation time for a third pixel row among the second rows is preferably determined by:

$$A-B(I-I_{last})^p (p=1,2, \ldots),$$

where I indicates a sequential index of the third pixel row, $I_{last}$ indicates a sequential index of the last second pixel row, and A and B are values determined by characteristics of the liquid crystal panel. The values A and B may be stored in a memory disposed at either inside or outside of the signal controller and the signal controller calculates the first modulation time based on the expression $A-B(I-I_{last})^p$.

The pixel rows may be classified into at least two groups, and the first modulation time for each group may linearly increases along the data voltage moving direction.

The first modulation times for the pixel rows at boundaries of the groups are preferably stored in an internal or in an external memory of the signal controller.

The signal controller preferably provides a gate clock with a period increasing based on the first modulation time. A pulse of each gate signal starts in synchronization with a rising edge of the gate clock and finishes at a next rising edge of the gate clock.

The liquid crystal display may further include a delay circuit including a resistor and a capacitor connected in series between the signal controller and a reference voltage. It is preferable that the signal controller provides a first signal for the delay circuit and receives a second signal from the delay circuit, and the first modulation time is determined by a delay between the first signal and the second signal.

The first modulation time for a pixel row is preferably determined by a polynomial expression having the first modulation time for at least one pixel row as a coefficient. The first modulation time for the at least one pixel row is varied depending on the resistance of the resistor.

BRIEF DESCRIPTION OF THE DRAWINGS

The above and other objects and advantages of the present invention will become more apparent by describing preferred embodiments thereof in detail with reference to the accompanying drawings in which.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein.

Then, an LCD according to an embodiment of the present invention will be described with reference to the accompanying drawings.

Figure 1:
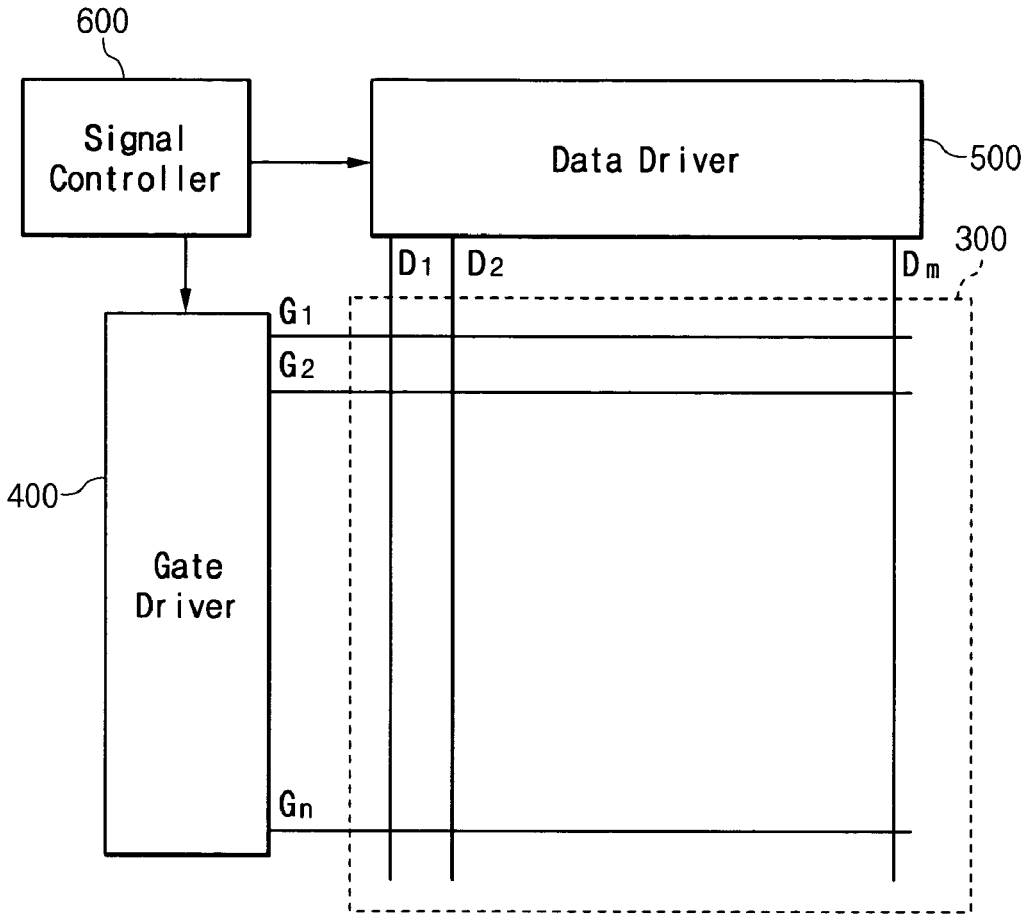
FIG. 1 is a schematic block diagram of an LCD according to an embodiment of the present invention.

FIG. 1 is a schematic block diagram of an LCD according to an embodiment of the present invention.

Referring to FIG. 1, an LCD according to an embodiment of the present invention includes a LC panel 300, a gate driver 400, a data driver 500, and a signal controller 600. The gate driver 400 and the data driver 500 are located near upper and left edges of the LC panel 300, respectively. A plurality of gate lines $G_1$–$G_n$ transmitting scan signals (also called gate signals) and extending substantially in a transverse direction and a plurality of data lines $D_1$–$D_m$ transmitting data signals and extending substantially in a longitudinal direction are provided on the LC panel 300. A plurality of pixels (not shown) connected to the gate lines $G_1$–$G_n$ and the data lines $D_1$–$D_m$ are arranged in a matrix on the LC panel 300.

The signal controller 600 supplies a plurality of RGB image signals to the data driver 500 and supplies a plurality of control signals for controlling the display of the image signals to the gate driver 400 and the data driver 500. The gate driver 400 generates gate signals and applies the generated gate signals to the gate lines $G_1$–$G_n$ in response to the control signals from the signal controller 600. The data driver 500 selects the data voltages corresponding to the image signals from the signal controller 600 and applies the data voltages to the data lines $D_1$–$D_m$ in response to the control signals from the signal controller 600.

Now, a method of generating gate signals according to an embodiment of the present invention is described in detail with reference to FIGS. 2–4.

It is assumed that the LCD is subject to double-dot inversion, and the data voltages applied to the pixels connected to even gate lines $G_{2i}$ (i=1, 2, . . . , n/2) have a polarity opposite that of the data voltages applied to the pixels connected to the previous gate lines. The LCD having SXGA (1280×1024) resolution serves as an example.

Figure 2:
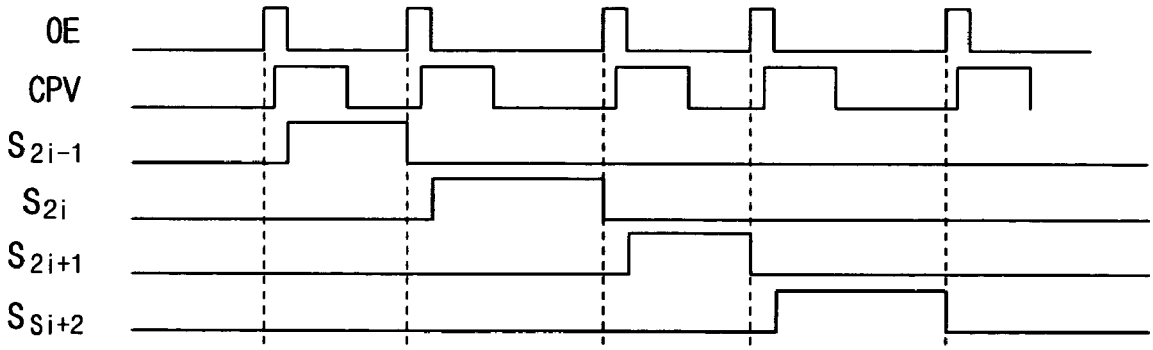
FIG. 2 is a timing diagram of gate signals according to an embodiment of the present invention.
Figure 3A:
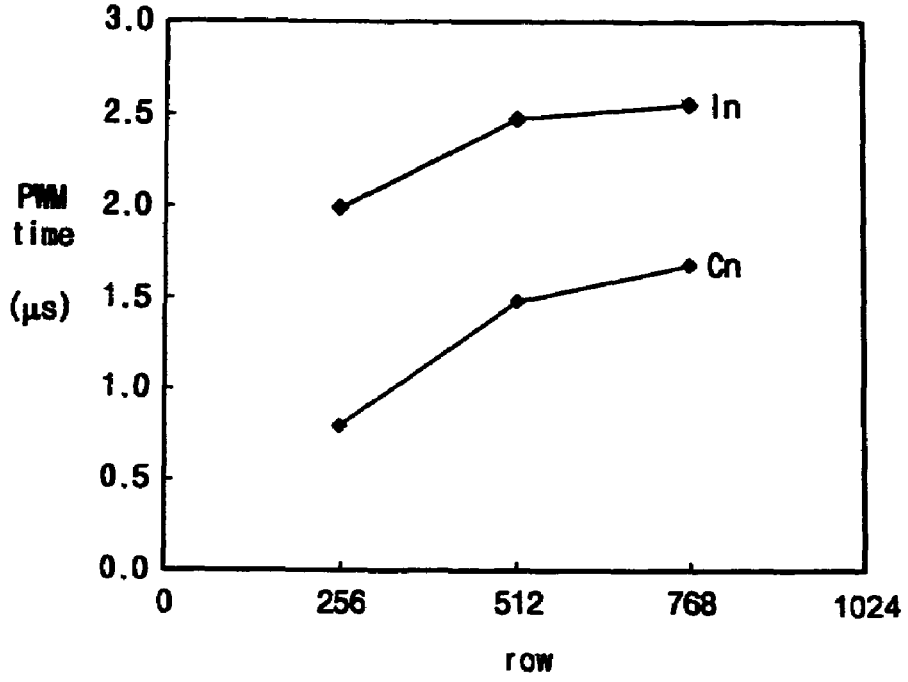
FIGS. 3A–3C are graphs showing a modulation time of gate signals for a left portion, a center portion, and a right portion of a LC panel, respectively.
Figure 3B:
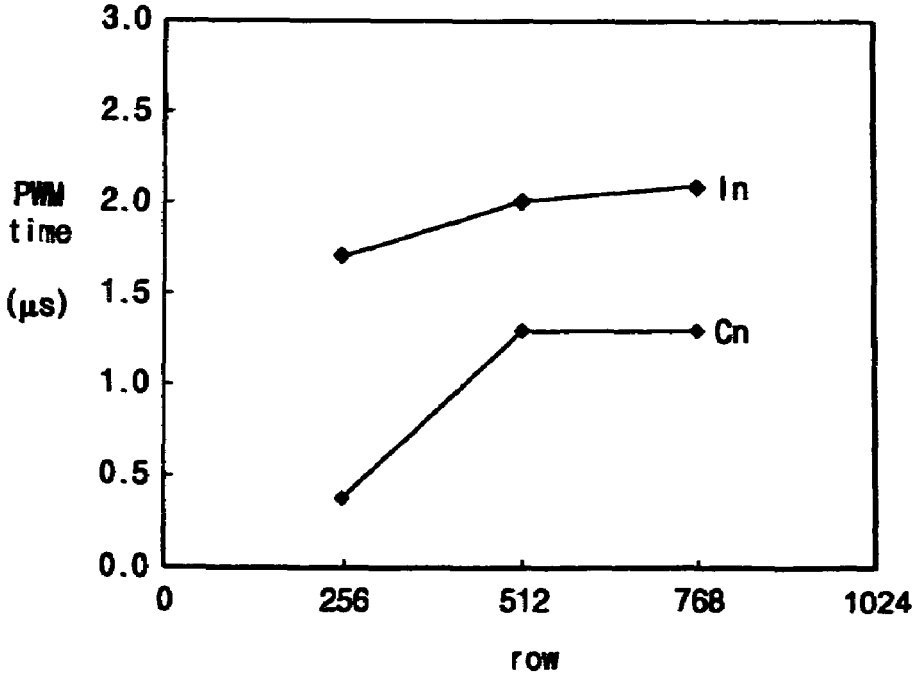
Figure 3C:
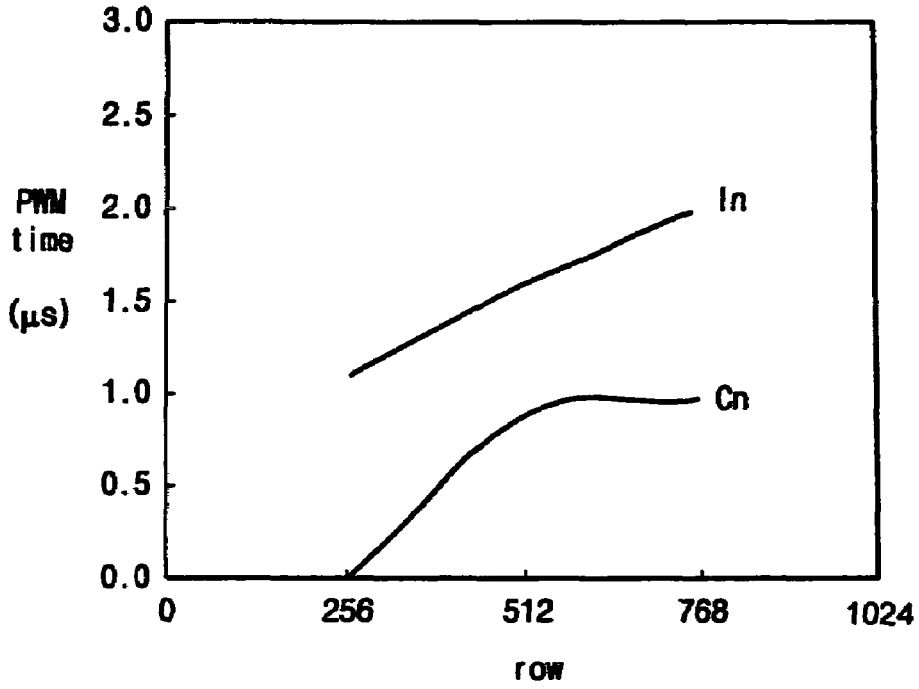
Figure 4:
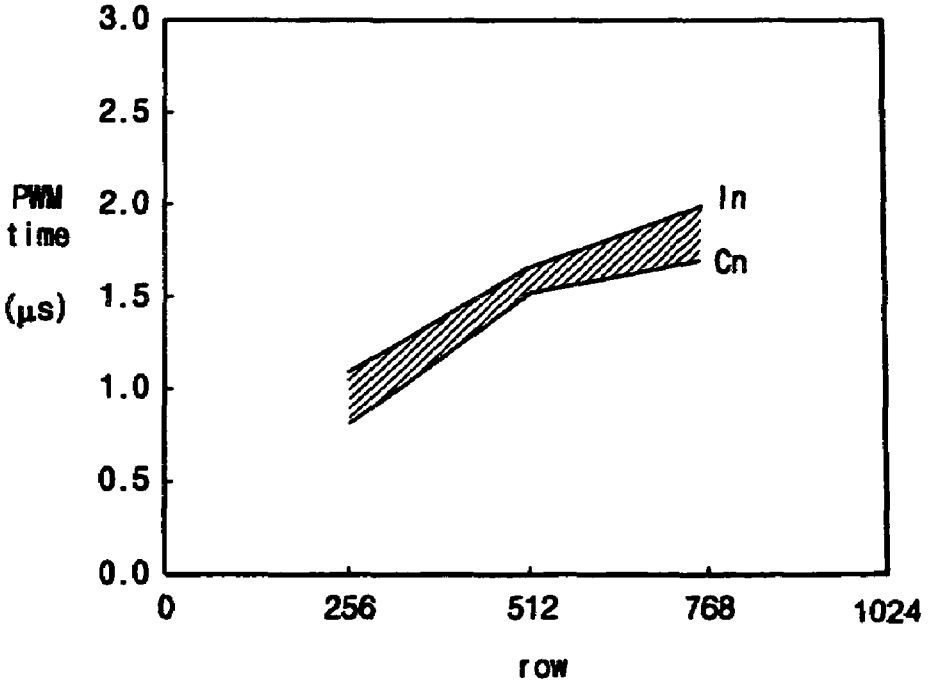
FIG. 4 is a graph showing a modulation time common to those shown in FIGS. 3A–3C.

FIG. 2 is a timing diagram of signals for an LCD according to an embodiment of the present invention, FIGS. 3A–3C show the modulation time of the gate signal for left, center, and right portions of the LC panel, respectively, and FIG. 4 shows the modulation time which is common to FIGS. 3A–3C.

According to the embodiment of the present invention, the duration of the gate-on voltage or the pulse width of a gate signal $S_{2i}$ applied to the even gate lines $G_{2i}$ is elongated by a predetermined pulse width modulation (PWM) time $W_{2i}$, and the duration of the gate-on voltage of a gate signal $S_{2i+1}$ or $S_{2i-1}$ applied to the adjacent odd gate lines $G_{2i+1}$ or $G_{2i-1}$ is shortened by the PWM time $W_{2i}$, as shown in FIG. 2. Preferably, the PWM time $W_{2i}$ is set to a degree that the data voltages are fully charged in the pixels connected to the even gate lines such that transverse stripes are not generated.

If the PWM time $W_{2i}$ is too large, the duration of the gate-on voltage of the gate signal $S_{2i+1}$ of the odd gate lines $G_{2i+1}$ becomes short, and then the charging time for the pixels connected to the even gate lines $G_{2i+1}$ becomes short. Then, a phenomenon that the pixels connected to the even gate lines $G_{2i+1}$ become darker in normally black mode and brighter in normally white mode (hereinafter "inversion of transverse stripes") may be generated. Therefore, the PWM time $W_{2i}$ preferably falls between a minimum value $C_{2i}$ capable of compensating the charging time of the pixels connected to the even gate lines $G_{2i}$ and a maximum value $I_{2i}$ capable of preventing the inversion of transverse stripes as shown in FIGS. 3A–3C.

When the gate driver 400 is located near the left edge of the LC panel 300, the modulation time for compensating the charging time of the data voltages becomes smaller as it goes to the right due to the delay of the gate signal. That is, the minimum and the maximum values are lower in a right portion of the LC panel 300 than in a left portion of the LC panel 300 as shown in FIGS. 3A–3C. However, since it is difficult to differentiate the PWM time for the left portion, the center portion, and the right portion of the LC panel 300, the modulation time is determined to be in an area common to three cases as shown in FIG. 4.

Since the load of the data lines become larger as it goes to the lower edge of the LC panel 300, the delay of the data signals is also increased. Therefore, as shown in FIGS. 3A–3C and 4, it is preferable that the modulation time for the gate signals becomes larger as it goes to the lower edge of the LC panel 300 in consideration of the delay of the data signals.

An exemplary method of determining the modulation time is described in detail with reference to FIGS. 5–8.

Figure 5:
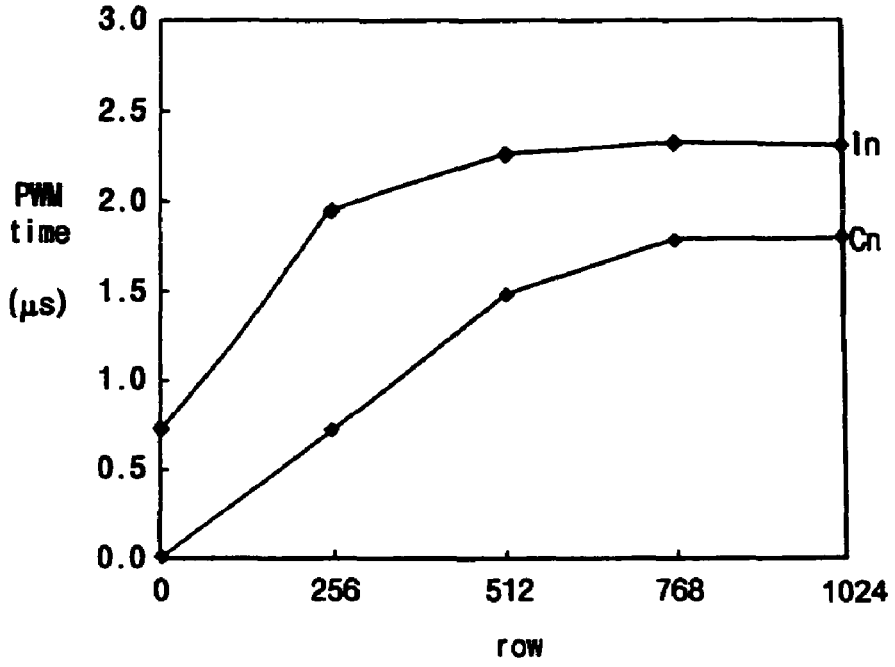
FIG. 5 is a graph showing a PWM time of gate signals required for a LC panel.
Figure 6:
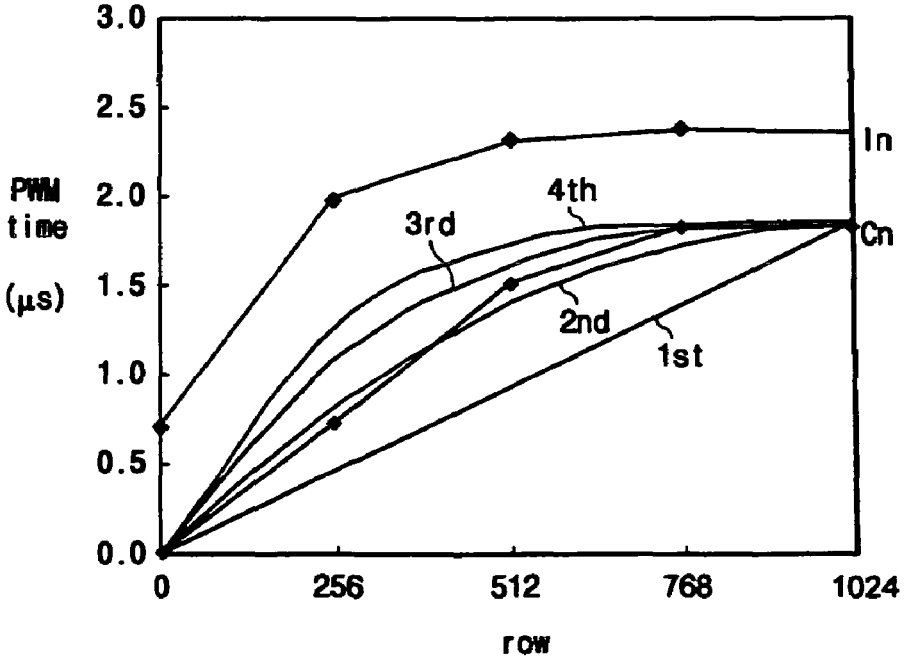
FIGS. 6–8 are graphs showing PWM times of gate signals according to embodiments of the present invention.
Figure 7:
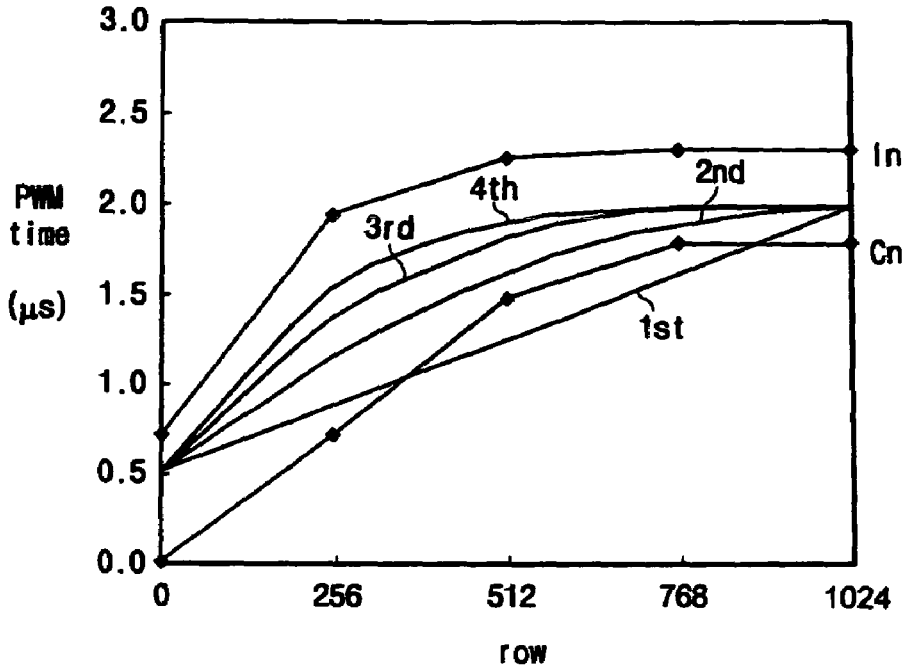
Figure 8:
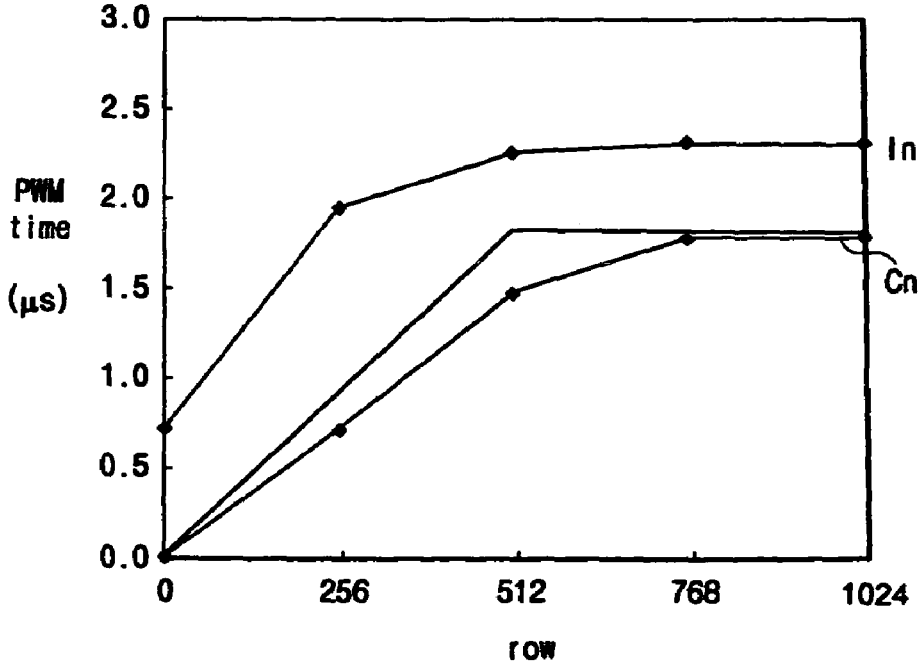

FIG. 5 is a graph showing a PWM time of the gate signals required for an LC panel, and FIGS. 6–8 are graphs showing the PWM time of the gate signals according to embodiments of the present invention.

FIG. 5 shows a range from Cn to In of a PWM time for preventing transverse stripes and inversion of transverse stripes.

Referring to FIG. 6, a gate signal for the first even gate line is not modulated, and the modulation time of a gate signal of the last even gate line is set to the minimum value Cn. The PWM time of the gate signals is determined by first through fourth order polynomials expressions. Here, the modulation time $W_{2i}$ is given by:

$$W_{2i}=W_{1024}-A(2i-1024)^N(N=1,2,3,4), \quad (1)$$

where 2i indicates the index of the gate line $G_{2i}$ and A is a value for determining a modulation time curve, which is determined by the modulation time $W_2$ of the gate signal $S_2$ applied to the first even gate line $G_2$ and is given by $$\frac{W_{1024}}{(2-1024)^N}.$$

As shown in FIG. 6, the transverse stripes may be generated a lot when the first order modulation is performed, and they may be generated on some areas in case of the second order modulation. Therefore, at least third order modification is preferred when the modulation time of the gate signals $S_2$ and $S_{1024}$ applied to the first even gate line $G_2$ and the last even gate line $G_{1024}$ are the minimum values. However, the second order modulation may not generate transverse stripes in some cases due to the characteristics of the LC panel 300.

Given A and $W_{1024}$, the PWM time $W_{2i}$ for the gate signal $S_{2i}$ of any even gate line $G_{2i}$ can be obtained by logic operation of the signal controller 600 according to Equation 1. The values A and $W_{1024}$ can be stored in an internal memory or in an external memory of the signal controller 600, and the signal controller 600 receives the values A and $W_{1024}$ from the external memory using a digital bus such as $I^2C$ when they are stored in the external memory. The signal controller 600 adjusts the duration of the gate-on voltage of a gate signal after calculating the modulation time for the gate signal given by Equation 1 based on the stored values A and $W_{1024}$. That is, the signal controller 600 widens the pulse width of the gate signal $S_{2i}$ for the gate line $G_{2i}$ by the calculated modulation time $W_{2i}$, and reduces the duration of the gate-on voltage of the gate signal $S_{2i+1}$ or $S_{2i-1}$ for an adjacent gate line $G_{2i+1}$ or $G_{2i-1}$ by the modulation time $W_{2i}$.

The PWM time of the gate signals is adjusted by controlling the timings of a gate clock signal CPV and an output enable signal OE as shown in FIG. 2. The gate driver 200 outputs a gate-on voltage for a duration limited by a range from a rising edge of the gate clock signal CPV to a next rising edge of the CPV signal, and the gate-on voltage starts from a falling edge and finishes at a following rising edge of the output enable signal OE. Therefore, the signal controller 600 changes the period of the gate clock signal CPV with the modulation time and adjusts the timing of the output enable signal OE for the PWM of the gate signal.

Next, as shown in FIG. 7, the gate signal $S_2$ applied to the first even gate line $G_2$ is modulated by a predetermined time, and the modulation time of the gate signal $S_{1024}$ applied to the last even gate line $G_{1024}$ has a value between the minimum value and the maximum value. Then, the value A in Equation 1 is given by $$\frac{W_{1024}-W_2}{(2-1024)^N}.$$

In this case, the second order PWM modulation does not generate transverse stripes and inversion of transverse stripes as shown in FIG. 7.

As shown in FIG. 8, the PWM time for the gate signals applied to the gate lines located in an upper half of the LC panel 300 and that in a lower half of the LC panel 300 are calculated using different first order expressions such as Equation 2 and Equation 3, respectively:

$$W_{2i}=W_{512}+\frac{W_{512}-W_2}{512-2}(2i-512); \text{ and} \quad (2)$$

$$W_{2i}=W_{1024}+\frac{W_{1024}-W_{512}}{1024-512}(2i-1024). \quad (3)$$

If the value $W_2$ for the first even gate line $G_2$, the value $W_{1024}$ for the last even gate line $G_{1024}$, and the value $W_{512}$ for the boundary gate line $G_{512}$ are given, the modulation time for each gate line can be determined using Equation 2 and Equation 3.

This PWM does not generate transverse stripes and inversion of transverse stripes on any areas as shown in FIG. 8.

The PWM time can be determined by three or more first order equations for the respective gate line groups.

Although the modulation time $W_{1024}$ for the last even gate line $G_{1024}$ is stored in a memory in the above-described embodiments of the present invention, it is adjustable. Such an embodiment will be described with reference to FIGS. 9 and 10.

Figure 9:
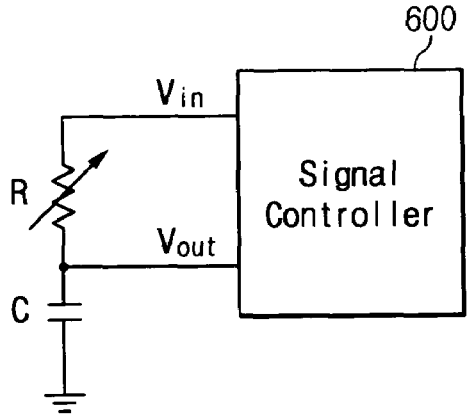
FIG. 9 shows a signal controller as well as a delay circuit according to an embodiment of the present invention.
Figure 10:
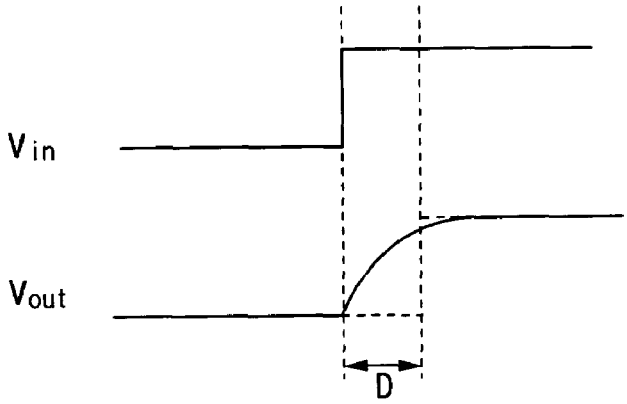
FIG. 10 is a timing diagram of input/output signals of the signal controller shown in FIG. 9.

FIG. 9 shows a signal controller along with an RC circuit according to an embodiment of the present invention, and FIG. 10 shows input/output waveforms of the signal controller shown in FIG. 9.

Referring to FIG. 9, an RC circuit according to an embodiment of the present invention includes a variable resistor R and a capacitor C connected in series between a signal controller 600 and a ground. The variable resistor R receives an input signal Vin from the signal controller 600 and the RC circuit outputs a signal Vout through a node between the resistor R and the capacitor C to the signal controller 600. As shown in FIG. 10, the input signal Vin is delayed by the RC circuit to be outputted as the output signal Vout, which is given by:

$$Vout=\left(1-e^{-\frac{1}{RC}t}\right)Vin, \quad (4)$$

where R indicates the resistance of the resistor R and C indicates the capacitance of the capacitor C.

The signal controller 600 measures the delay D of the output signal Vout to the input signal Vin using a clock and adjusts the modulation time $W_{1024}$ of the gate signal applied to the last even gate line $G_{1024}$ based on the delay D. Since the delay D is determined by a time constant equal to the resistance R multiplied by the capacitance C, the modulation time is changed depending on the resistance of the variable resistor R. Therefore, the modulation time which does not generate transverse stripes can be found by varying the resistance of the resistor R.

As shown in FIG. 4, the PWM time of the gate signals is determined such that it lies within a compensation area common to three cases shown in FIGS. 3A–3C. Since the compensation area is varied depending on the fabrication conditions of the LC panel 300, there may be no common area or a narrow common area. In this case, the compensation area needs to be widened. Such an embodiment is now described with reference to FIG. 11.

Figure 11:
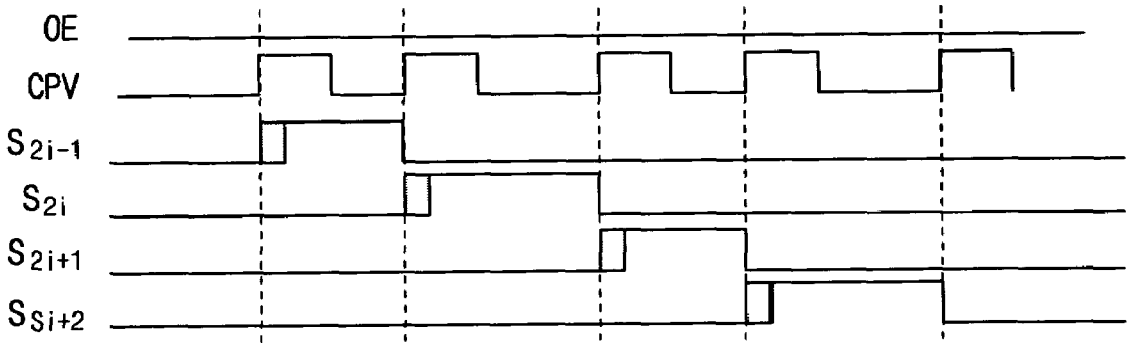
FIG. 11 is a timing diagram of gate signals according to another embodiment of the present invention.

FIG. 11 is a timing diagram of gate signals according to an embodiment of the present invention.

This embodiment increases the duration of the gate-on voltage for all gate signals for enlarging compensation areas by, for example, removing an output enable signal OE. That is, the signal controller 600 does not provide the output enable signal OE for the gate driver 400. Then, the pulse width of the gate signals equals to one period of a gate clock signal CPV as shown in FIG. 11. Therefore, the signal controller 600 changes the period of the gate clock signal CPV by the modulation time to obtain the PWM of the gate signals.

According to the above-described embodiments of the present invention, the pulse width of the gate signals applied to the odd gate lines is decreased by the increment of the pulse width of the gate signals applied to the adjacent even gate lines. However, the increased time for the pulse width of the even gate signals and the decreased time for the pulse width of the odd gate signals may be different. Alternatively, the pulse width of the odd gate signals may not be decreased.

As described above, transverse stripes and inversion of transverse stripes are not generated because the pulse width of the gate signals is increased or decreased by an appropriate amount in consideration of required charging time.

While the present invention has been described in detail with reference to the preferred embodiments, it is to be understood that the invention is not limited to the disclosed embodiments, but, on the contrary, is intended to cover various modifications and equivalent arrangements included within the sprit and scope of the appended claims.

What is claimed is:

1. A liquid crystal display comprising:

a liquid crystal panel including a plurality of pixel rows, a plurality of data lines for transmitting data voltages to the pixel rows, a plurality of gate lines for transmitting gate signals to the pixel rows;

a signal controller for generating a control signal for controlling timing of the gate signals;

a data driver for providing the data voltages for the pixel rows through the data lines under control of the signal controller; and a gate driver for providing the gate signals to the pixel rows in sequence through the gate lines based on the control signal of the signal controller, wherein the pixel rows includes a plurality of pairs of first and second pixel rows adjacent to each other, sequentially arranged in a data voltage moving direction, and supplied with the data voltages having different polarities, the gate signals include first and second gate signals respectively applied to the first and the second pixel rows, and pulse widths of the second gate signals are increased by first modulation times, the first modulation times falling between a minimum value capable of compensating the charging time of pixels in the second pixel rows and a maximum value capable of preventing the inversion of transverse stripes.

2. The liquid crystal display of claim 1, wherein pulse widths of the first gate signals are decreased by second modulation times.

3. The liquid crystal display of claim 2, wherein the polarity of the data voltages are reversed every two pixel rows and the first modulation times are substantially equal to the respective second modulation times.

4. The liquid crystal display of claim 1, wherein the first modulation time for one of the second pixel rows farther from inputs of the data voltages has a larger value than the first modulation times for the second pixel rows preceding the one of the second pixel rows.

5. The liquid crystal display of claim 4, wherein the first modulation time for a third pixel row among the second rows is determined by:

$$B-A(I-I_{last})^p (p=1,2,3,4),$$

where I indicates a sequential index of the third pixel row, $I_{last}$ indicates a sequential index of the last second pixel row, and A and B are values determined by characteristics of the liquid crystal panel.

6. The liquid crystal display of claim 5, wherein the values A and B are stored in a memory disposed at either inside or outside of the signal controller and the signal controller calculates the first modulation time based on the expression $B-A(I-I_{last})^p$.

7. The liquid crystal display of claim 4, wherein the pixel rows are classified into at least two groups, and the first modulation time for each group linearly increases along the data voltage moving direction.

8. The liquid crystal display of claim 7, wherein the first modulation times for the pixel rows at boundaries of the groups are stored in an internal or in an external memory of the signal controller.

9. The liquid crystal display of claim 1, wherein the signal controller provides a gate clock with a period increasing based on the first modulation time, and a pulse of each gate signal starts in synchronization with a rising edge of the gate clock and finishes at a next rising edge of the gate clock.

10. The liquid crystal display of claim 1, further comprising a delay circuit including a resistor and a capacitor connected in series between the signal controller and a reference voltage, the signal controller provides a first signal for the delay circuit and receives a second signal from the delay circuit, and the first modulation time is determined by a delay between the first signal and the second signal.

11. The liquid crystal display of claim 10, wherein the first modulation time for a pixel row is determined by a polynomial expression having the first modulation time for at least one pixel row as a coefficient.

12. The liquid crystal display of claim 11, wherein the first modulation time for the at least one pixel row is varied depending on the resistance of the resistor.

* * * * *